US005688129A

United States Patent [19]

Flaherty

[11] Patent Number: 5,688,129

[45] Date of Patent: Nov. 18, 1997

[54] ELECTRICAL CONNECTOR WITH LEAD POSITIONING COMB

[76] Inventor: Roger J. Flaherty, 4507 Tower Rd., Greensboro, N.C. 27410

[21] Appl. No.: 561,577

[22] Filed: Nov. 21, 1995

[51] Int. Cl.[6] ..... H01R 9/09

[52] U.S. Cl. ..... 439/79

[58] Field of Search ..... 439/79, 80, 571, 439/573, 569, 564

[56] References Cited

U.S. PATENT DOCUMENTS

| | | | |
|---|---|---|---|
| 3,760,335 | 9/1973 | Roberts | 439/398 |
| 4,469,387 | 9/1984 | McHugh | 439/140 |
| 4,721,473 | 1/1988 | Delguidice et al. | 439/79 |
| 4,792,307 | 12/1988 | Stewart, Sr. | 439/741 |
| 4,857,017 | 8/1989 | Erk | 439/695 |
| 4,955,819 | 9/1990 | Harting et al. | 439/79 |
| 5,004,430 | 4/1991 | DelGuidice | 439/350 |
| 5,037,334 | 8/1991 | Viselli | 439/733 |
| 5,112,233 | 5/1992 | Lybrand | 439/79 |
| 5,199,886 | 4/1993 | Patterson | 439/79 |
| 5,213,515 | 5/1993 | Ishikawa et al. | 439/79 |
| 5,252,080 | 10/1993 | Pesson | 439/79 |
| 5,346,404 | 9/1994 | Shimada | 439/108 |
| 5,354,207 | 10/1994 | Chikano | 439/79 |

FOREIGN PATENT DOCUMENTS 0335160 10/1989 Germany .

OTHER PUBLICATIONS

AMP Customer Drawing C–552740 Feb. 6, 1990.
AMP Customer Drawing C–552741 Aug. 13, 1990.
AMP Customer Drawing C–555520 Oct. 6, 1993.
AMP Customer Drawing C–569196 Mar. 31, 1995.
AMP Customer Drawing C–719075 Sep. 1, 1995.
AMP Customer Drawing C–745438 Sep. 5, 1989.
AMP Customer Drawing C–174207 1991.

*Primary Examiner*—Neil Abrams
*Assistant Examiner*—Barry Matthew L. Standig

[57] ABSTRACT

An electrical connector assembly 2 for use with a printed circuit board 6 includes an electrical connector 4, such as a standard miniature ribbon connector, and an injection molded lead positioning comb 48. Cantilever beams 54 in the lead positioning comb 48 form lead receiving slots 52 into which terminal leads 40 extending at right angles from terminals 26 inserted into a connector housing 8 precisely position rows of leads 40 for insertion into printed circuit board holes or on surface mount pads. The slots 52 on the lead positioning comb 48 face the connector housing 8 and the comb 48 is snapped to the housing from the rear. As the comb is snapped to the housing, the terminal leads enter the slots. Carrier strips 46 join terminals in each row during insertion of the leads into the slots to prevent deflection. The carrier strips 46 are removed after assembly of the comb 48 to the housing 4. Relief slots 55 are formed to permit adjacent beams 54 to deflect during simultaneous insertion of all of the terminal leads. The beams 54 are molded by two mold halves that are retracted perpendicular to the plane of the cantilever beams.

16 Claims, 8 Drawing Sheets

ELECTRICAL CONNECTOR WITH LEAD POSITIONING COMB

BACKGROUND OF THE INVENTION

1. Field of the Invention

This invention is related to electrical connectors, especially electrical connectors mounted on printed circuit boards. More specifically this invention is related to input/output (I/O) electrical connectors having terminals extending at right angles from one side of the connector so that the terminals can be soldered or otherwise connected to the traces on a printed circuit board. Even more specifically, this invention is related to lead positioning apparatus that is used to precisely position the leads in a prescribed pattern so that they will be aligned with plated through holes or surface mount pads on a printed circuit board.

2. Description of the Prior Art

There are a number of commercially available printed circuit board electrical connectors that employ lead positioning means to precisely position terminal leads for registry with plated through holes or surface mount pads on a printed circuit board. Typically these connector assemblies are referred to as vertical mount (top entry) or right angle mount (side entry) versions and are used for input and output to the printed circuit board. In vertical mount versions, the terminal leads extend straight from the connector housing into a corresponding pattern of holes or pads on a printed circuit board with the mating face of the connector facing upward, hence the name top entry. Right angle mount or side entry versions are positioned with the mating face oriented perpendicular to the surface of the printed circuit board so that a mating electrical connector is inserted from the side, usually along the edge of the printed circuit board. These right angle versions employ terminal leads bent at a right angle from the axis of the terminal on the mating face of the right angle I/O electrical connector.

For some prior art electrical connectors, the connector housing includes a plurality of rearwardly facing slots into which the lead portions of the terminals are bent. For electrical connectors employing relatively rigid terminal leads, such as 0.025 inch square posts, these slots need not grip the terminal leads to prevent back and forth movement of the terminals in the slots. However, terminals in many prior art electrical connectors are stamped and formed from a flat metal stock and the thickness of the stock is determined not by the requirements of the terminal lead portion, but by the requirements, including insertion force, of the mating portion of the terminal. The stock used for many prior art applications is therefore thin enough to provide the requisite mating flexibility. The terminal lead portions are also relatively flexible so that some means must be provided to keep the relatively flexible leads properly aligned. One approach is to form the relatively thin metal stock in a closely spaced U-shape so that the cross section of the terminal lead section resembles a square post prior to bending the terminal lead section at a right angle. These formed leads will then retain their positional alignment even though they are held in position only by slots that do not grip the terminal leads to prevent front to back movement of the terminal leads in the slots. An example of such prior art electrical connectors is manufactured and sold by AMP Incorporated under the trademark AMPLIMITE and is identified by AMP Incorporated Part Number 748837. AMPLIMITE is a trademark of the Whitaker Corporation.

Other electrical connectors that employ rearwardly facing partitions integrally molded in the connector housing to form rearwardly facing slots do include some form of positioning means in the form of bump or other restricting contour on the sides of the partitions to precisely position the terminal leads on common centerline distances of 0.050 inch, 0.085 inch and 0.100 inch. This approach requires the partitions to flex outwardly as the terminals are inserted into the slots so that the terminals can pass these restrictions in the slots. This outward movement of the partitions means that all of the terminals cannot be simultaneously formed into the slots because the opening of the next adjacent slot is narrowed as the partitions flex outwardly to receive each terminal lead. The common prior art approach is then to sequentially stitch the terminal leads, one at a time, into the slots. A prior art example of an electrical connector stitched into rearwardly facing slots is manufactured and sold by AMP Incorporated under the trademark CHAMP and is identified as AMP Incorporated Part Number 178042.

One prior art printed circuit board electrical connector assembly employs a lead positioning bracket with a miniature ribbon electrical connector. This prior art assembly is manufactured and sold by AMP Incorporated and is identified as Part Number 555520. The terminals in this prior art connector are bent at right angles on the rear of the connector so that the assembly can be mounted as a right angle connector adjacent the edge of the printed circuit board. The lead positioning brackets are attached to the miniature ribbon connector by first removing the carrier strip to free the ends of each terminal lead. The ends of the bent leads are then inserted into holes in the lead positioning bracket which is then inserted axially relatively to the local axis of the bent leads. The lead positioning bracket includes latches for snapping the lead positioning bracket to the miniature ribbon electrical connector, but housing ribs or partitions that separate adjacent contacts on a cable connector have been omitted to provide space for attaching the bracket to the miniature ribbon electrical connector. This omission requires molding a different housing for a cable connector and for a printed circuit board version. The assembly of the lead positioning bracket to the electrical connector is also complicated because the free ends of each of a large number of terminal leads must be inserted into the corresponding holes in the lead positioning bracket. Although these holes in the bracket do provide a beveled lead in to simplify this task, it can still be difficult to align all of the terminal free ends with the corresponding holes.

Each of the prior art approaches discussed to this point requires a connector manufactured specifically for a printed circuit board application. The mating interface for these connectors is typically the same as that for a corresponding cable connector. Indeed most of these I/O connectors are mated with a cable connector that is part of the same connector family. One prior art printed circuit board electrical connector uses a lead positioning adapter that can be mounted on the rear of a standard cable connector housing. Although the terminals for the printed circuit board version of this connector differ from those used for the cable version, the same connector housing can be employed. Only relatively simple relatively inexpensive molded parts must be fabricated for this prior art adapter, eliminating the need for more costlier connector housing molds. Since connectors of this type are generally offered in a large number of positions, the advantage of molding simpler adapter parts is important. This prior art connector with lead positioning adapter is manufactured and sold by AMP Incorporated in receptacle and plug versions as Part Number 552740 and 552741. This connector assembly is also shown in U.S. Pat. No. 4,721,473 in the names of Henry L. Delguidice and Roger J. Flaherty.

The advantages of this prior art connector are however limited because the lead positioning adapter includes three separate parts that must be assembled to the standard miniature ribbon connector housing.

SUMMARY OF THE INVENTION

A single piece lead positioning comb that can be attached to a standard electrical connector housing with all of the terminal leads being simultaneously positioned in slots in the lead positioning comb during this one step assembly would overcome the disadvantages of the prior art printed circuit board connector assemblies discussed in the previous section. This lead positioning comb must be simple to mold since some of the disadvantages of the prior art arise from the difficulty of reliably and cost effectively molding the partitions that form the slots in which terminal leads are positioned. For example the prior art configurations do not lend themselves to the use of a unique pair of partitions to form each lead positioning slot. The opposite walls of each partition form a side of two adjacent slots. The use of a common partition for two adjacent slots arises from the difficulty of molding a gap in each partition between two slots on common centerlines of 0.050 inch, 0.085 inch or 0.100 inch. If relief slots are added to the lead positioning slots in a lead positioning member, the total number of slots that would have to be molded would be 2n+1, where n is the number of lead positioning slots. Since any relief slots must be thin, the mold blades that form the slots must also be thin. Since these blades must be thin, they must also be short so that they do not become too fragile and break during the required life of the mold. The blades must also be thin to permit the mold to fill properly so that the relatively thin molded partitions will be reliably formed. The rearwardly facing lead positioning slots and intervening relief slots could be fabricated with a side pull mold in which one mold part would be retracted away from the rear of the integrally molded housing while the remainder of the housing would be formed by two mold halves that are retracted from the top and bottom of the connector housing, directions that are orthogonal to the side pull. Such side pull molding is more expensive and time consuming than molds that do not involve side pulls and are therefore not as cost effective. The instant invention overcomes these problems because this one piece lead positioning comb can be fabricated without side pulls and the comb also includes relief slots that permit simultaneous insertion of all of the terminals in each row of the connector. This lead positioning comb can also be used with a standard cable connector housing and with simple stamped and formed terminals of the type used with earlier printed circuit board connectors. This lead positioning comb also mounts the connector on the printed circuit board and provides positional alignment of the terminals as they enter plated or unplated through holes or for soldering to surface mount pads on a printed circuit board. All of the terminals in a twenty four, thirty six or fifty position connector having twelve or eighteen or twenty five terminals in each of two rows can be adequately aligned by a simple lead positioning comb of this type. All of the terminal leads in both rows can be inserted in one operation, the attachment of the lead positioning comb to the connector, thus eliminating the need for sequential stitching operations. This lead positioning comb can also be automatically assembled.

The printed circuit board electrical connector assembly that is the subject of this invention includes an electrical connector housing, terminals extending from that housing and a lead positioning comb that is attached to the housing. In each row the terminals are bent at right angles. The lead positioning comb includes slots for individual terminal leads. Each slot is formed by a pair of cantilever beams. The beams are free to flex outwardly during insertion of the terminal leads because each beam is spaced from an adjacent beam forming an adjacent slot. The slots in the lead positioning comb face the connector housing and terminal leads so that the comb can be inserted from the rear of the housing. This lead positioning comb is especially useful when used with an electrical connector such as a miniature ribbon connector that employs essentially flat stamped and formed terminals having a thickness of 0.0085 to 0.010 inch. The thin terminal leads required by the mating interface of connectors of this type are flexible and this lead positioning comb positions all of the terminal leads for simultaneous insertion in a pattern of holes on a printed circuit board. A comb of this type can also provide proper registration for surface mount leads.

This lead positioning comb is attached to a standard electrical connector housing and is injection molded by using only two opposed straight pull mold halves without side pulls. Flexible cantilever beams forming the terminal lead positioning slots extend parallel to the parting line between the two mold halves. The open end of each slot faces the housing and adjacent nonpaired cantilever beams are separated by a relief slot. The base of the comb from which the beams extend is located at the rear of the comb so that the comb can be attached from the rear of the connector. The beams and slots are unobstructed above and below by other structures in the comb to provide clearance for movement of the two straight pull mold halves. Latches to secure the lead positioning comb to the electrical connector housing are located on opposite sides of the array of cantilever beams and slots.

This lead positioning comb attaches to the rear of either a standard plug or receptacle cable connector housing. In the preferred embodiment, this standard electrical connector is a miniature ribbon connector. The latches snap to the rear side of the standard housing and the lead portioning comb supports the electrical connector parallel to a printed circuit board to form a right angle connector.

The terminals are inserted into the electrical connector housing from the rear. Each row of terminals extend from a common carrier strip at the rear and therefore can be inserted into the connector housing as a unit. Each array of terminals is then bent at a right angle on the rear of the connector housing with the carrier strip remaining attached to the individual terminals. The lead positioning comb is attached to the rear of the connector housing and the leads in each row are simultaneously inserted into corresponding slots on the comb. The carrier strip still remains intact so that the terminal leads are not free to deflect. After the leads are properly positioned in the slots, the carrier strip can be removed and the leads cut to length for use with through holes in a printed circuit board or with surface mount printed circuit board pads.

DETAILED DESCRIPTION OF THE PREFERRED EMBODIMENT

Figure 1:
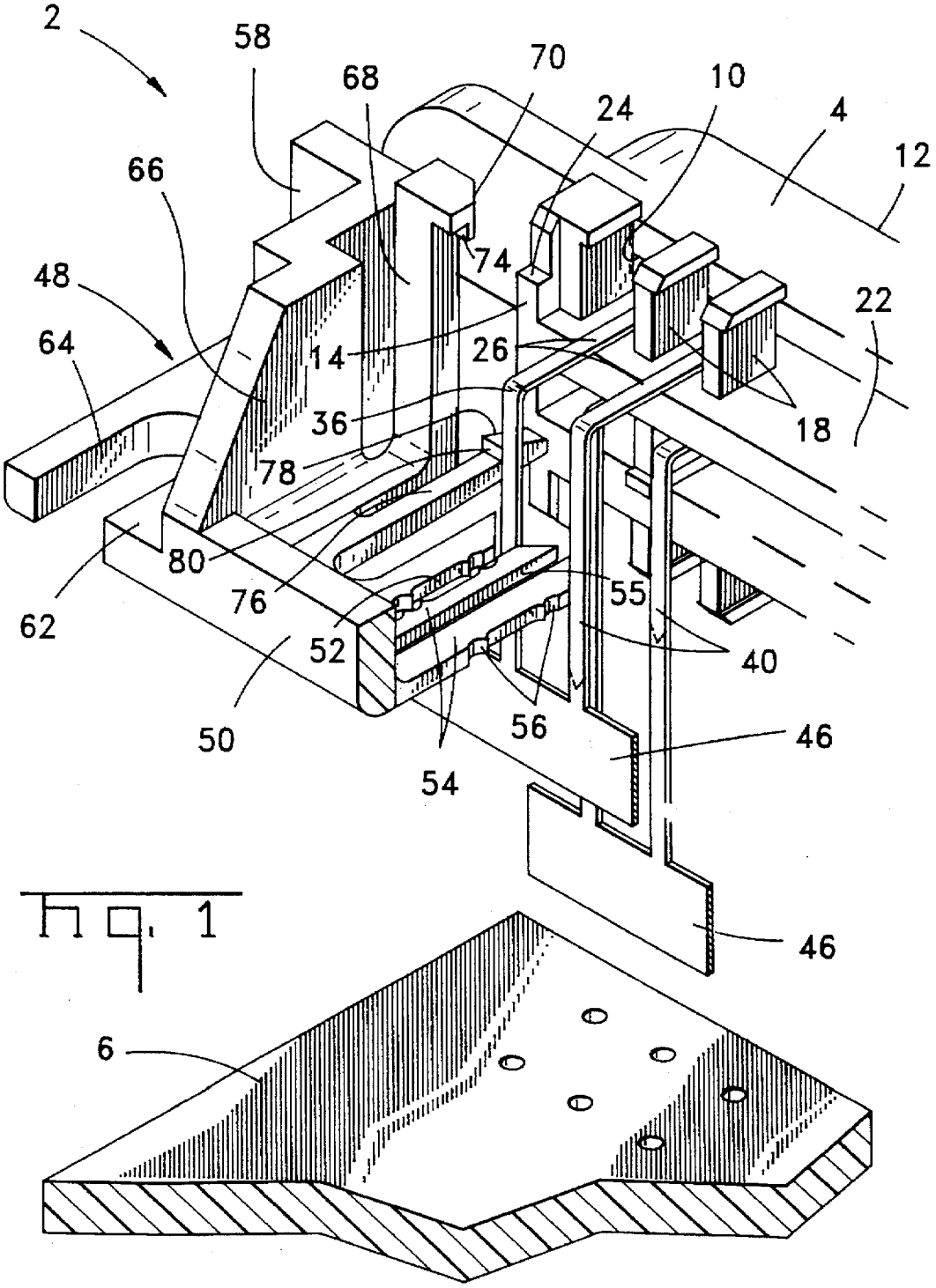
FIG. 1 is an exploded perspective view of the electrical connector assembly including a comb positioning terminal leads for insertion in an array of holes in a printed circuit board.

The preferred embodiment of the electrical connector assembly 2 includes an electrical connector 4 and a lead positioning comb 48 that can be mounted on a printed circuit board 6. The electrical connector 2 has a connector housing 8 and terminals 26 located in housing cavities 10 in two parallel rows. The terminals extend from a mating face 12 through the housing cavities 10 in a central housing wall 16 and out the rear housing face 14. The connector housing 8 is conventional in construction and in the preferred embodiment comprises a miniature ribbon connector housing. A miniature ribbon electrical connector is a connector having a male or plug half and a female or receptacle half having two rows of terminals. Each terminal 26 has a mating section 28 that is generally rectangular in cross-section and is resilient and arched so that a separable connection can be made with a mating connector. Male and female terminals are positioned on the mating face 12 of the housing so that they are opposed for mating. The mating sections of male connectors face outward and the mating sections of female connectors face inward. This mating face is standard so that numerous commercial variants of miniature connectors are intermatable. One example of a miniature ribbon connector used to interconnect cables is shown U.S. Pat. No. 3,760,335 incorporated herein by reference. Miniature ribbon connectors are a standard interface for telecommunications, computer and instrumentation applications. For example, the miniature ribbon connector mating interface is specified for FCC Part 68 interconnections and for use in an IEEE 488 General Purpose Information Bus, among others.

The miniature ribbon connector depicted herein differs from that disclosed in U.S. Pat. No. 3,760,335 in that this assembly is connected to a printed circuit board and is normally used as part of a cable to printed circuit board input/output or I/O connection. In all significant respects the connector housing used for a cable connector is the same as the housing used for this printed circuit board electrical connector assembly 2. The printed circuit board terminals 26 used in the preferred embodiment of this connector assembly differ from those used for a cable connector. The terminals 26 have a terminal load 40 extending from the rear of the housing instead of a wire terminating or insulation displacement portion as used at the rear face of a cable connector. The thickness of the terminals 26 is however determined by the standard mating interface requirements of the mating section 28 and mating housing face 12, which are unchanged. Terminals 26 having a thickness of 0.0085 and 0.010 inch can be employed in this printed circuit board mounted miniature ribbon connector. A spring metal such as phosphor bronze can be used for stamping and forming terminals 26. Although this thickness may be required to comply with the mating interface standards of a miniature ribbon connector, it is not ideal for insertion into an array of holes in a printed circuit board 6 because the terminal lead 40 is flexible and misalignment of only one terminal lead 40 will prevent insertion of the array of the terminal leads into the prescribed hole pattern in the printed circuit board. A similar problem arises when surface mount leads must be aligned with surface mount pads on a printed circuit board.

FIG. 1 shows both the miniature ribbon connector 4 and the lead positioning comb 48. In this view the lead positioning comb is spaced from the rear connector face 14 and the terminal leads 40 in the top row of terminals 26 are positioned at the entry of slots 52 formed by cantilever beams 54 in the lead positioning comb 48. The lead positioning comb 48 is assembled to the connector 4 upon forward movement into engagement with the rear face 14 of the connector 4. During this movement the terminal leads 40 in both the upper and lower terminal rows simultaneously move into the slots 52. Of course corresponding terminals in separate rows enter the slots sequentially during this same simultaneous mass insertion assembly operation, but only one assembly step is required. Carrier strips 46 join the rear ends of terminal leads 40 in each of the two terminal rows as the terminal leads 40 are inserted into slots 52 to prevent lateral deflection of the terminal leads 40 during assembly.

Figure 2:
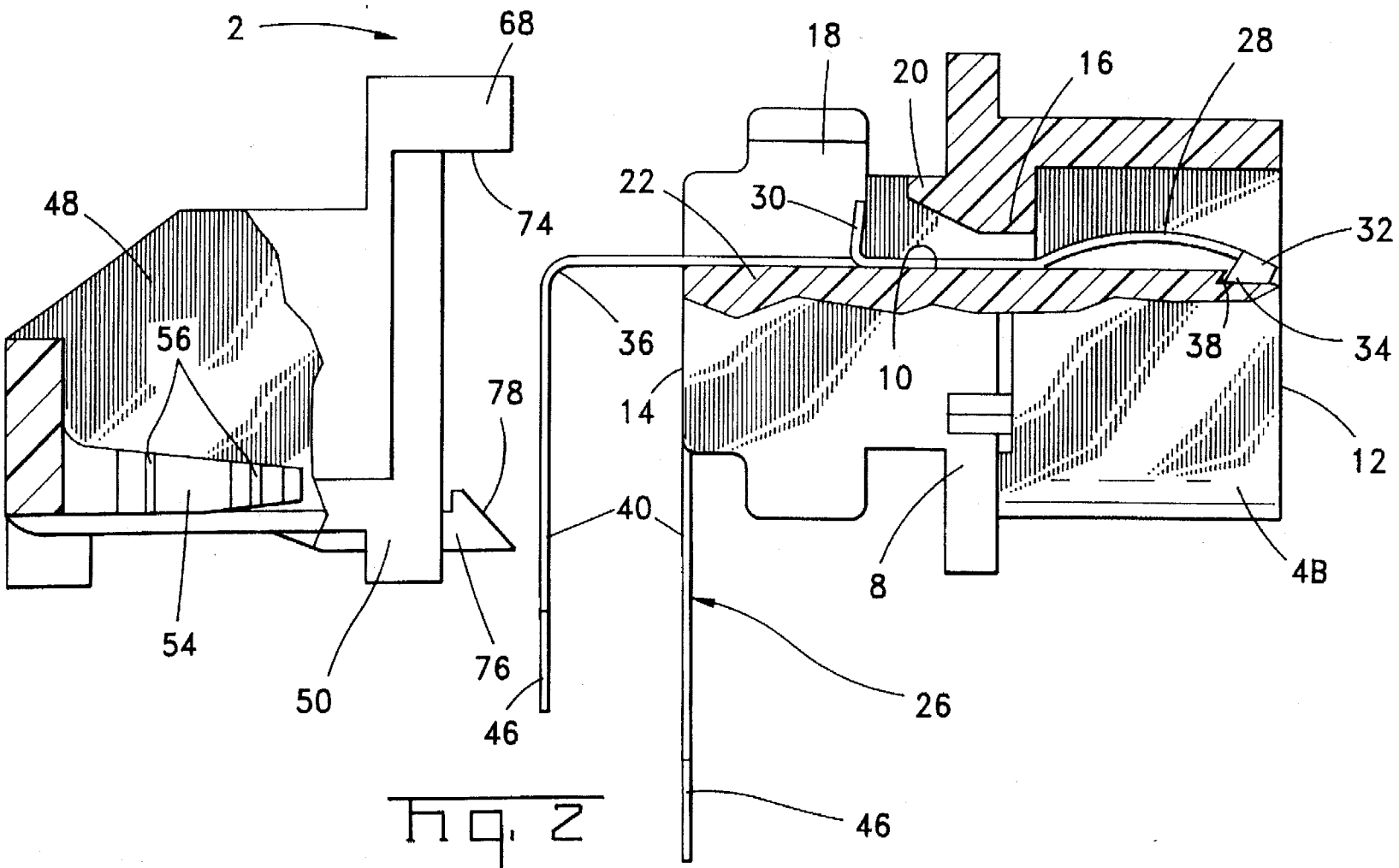
FIG. 2 is a side view partially in section showing the major components of the electrical connector assembly. The lead positioning comb is positioned at the rear of the connector prior to assembly to the connector.

The terminals 26 on carrier strips 46 are inserted into the connector housing 8 from the rear housing face 14 before the terminal loads 40 are bent at right angles. The straight terminals are inserted into cavities 10, one of which is shown in FIG. 2, into the mating face 12. Two rows of cavities 10 extend through a central wall 16 between the rear face 14 and the mating face 12. The terminal rows are located on opposite sides of a central housing rib 22. Partitions or separators 18 extend from the housing rib 22 to separate adjacent terminals 26. A ledge 24 is located at both ends of the row of partitions 18. As shown in FIG. 2, a contact stop shoulder 20 is located on each partition 18. These stop shoulders prevent movement of stop tabs 30 into the cavities 10 so that each terminal is prevented from moving forward beyond its fully inserted position. Each terminal 26 also includes a latch 34 at the terminal distal end 32. This latch 34 engages a surface 38 on the housing mating face 12 upon complete insertion of the terminal. Latch 34 prevents retraction of the terminal.

Figure 3:
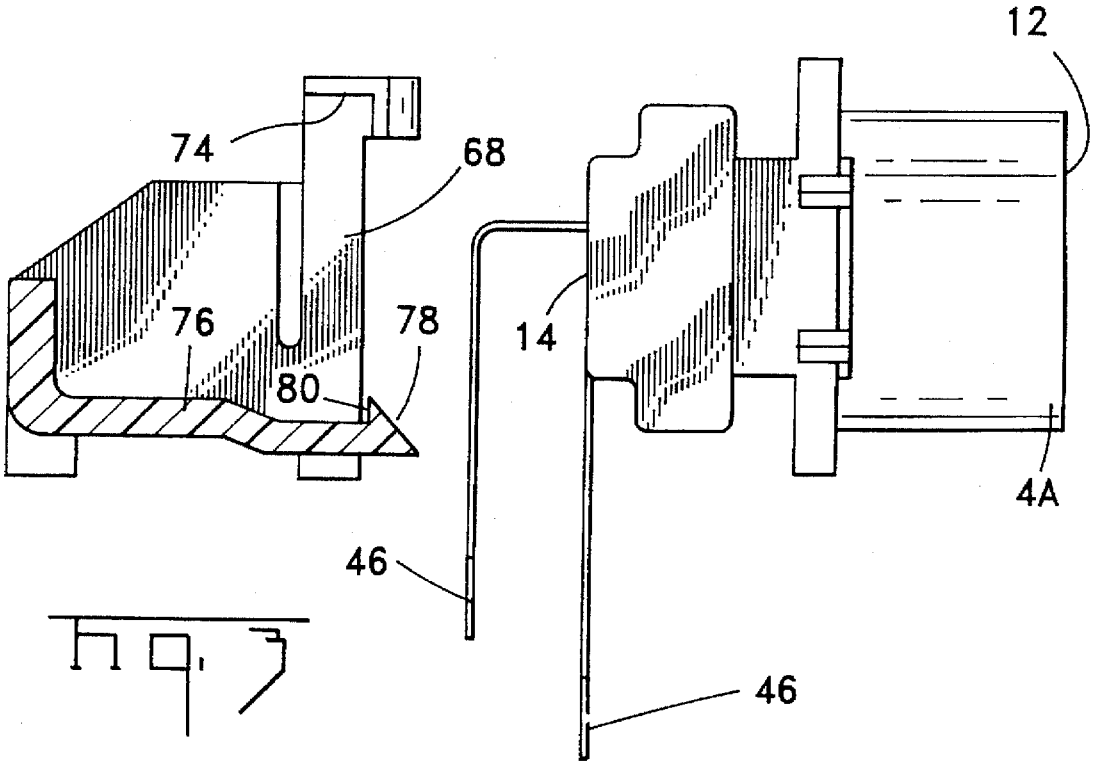
FIG. 3 is a side view similar to FIG. 2, but showing one of the comb latches in section.
Figure 4:
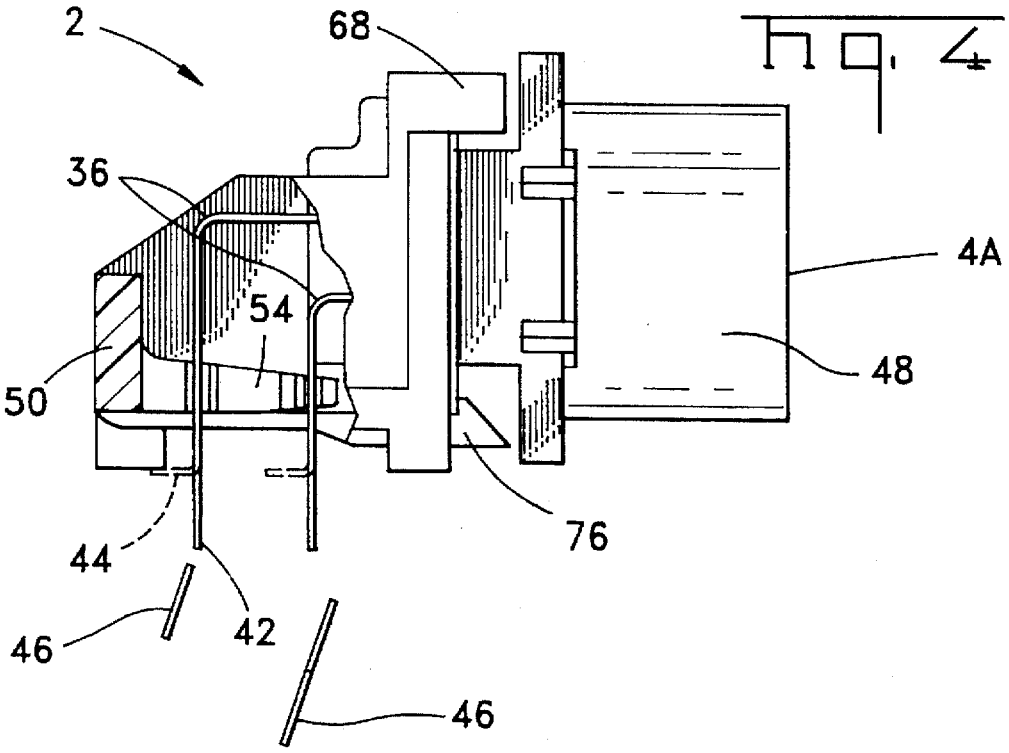
FIG. 4 is a side view showing the lead positioning comb assembled to the electrical connector and also showing removal of the carrier strips from two rows of terminals.
Figure 5:
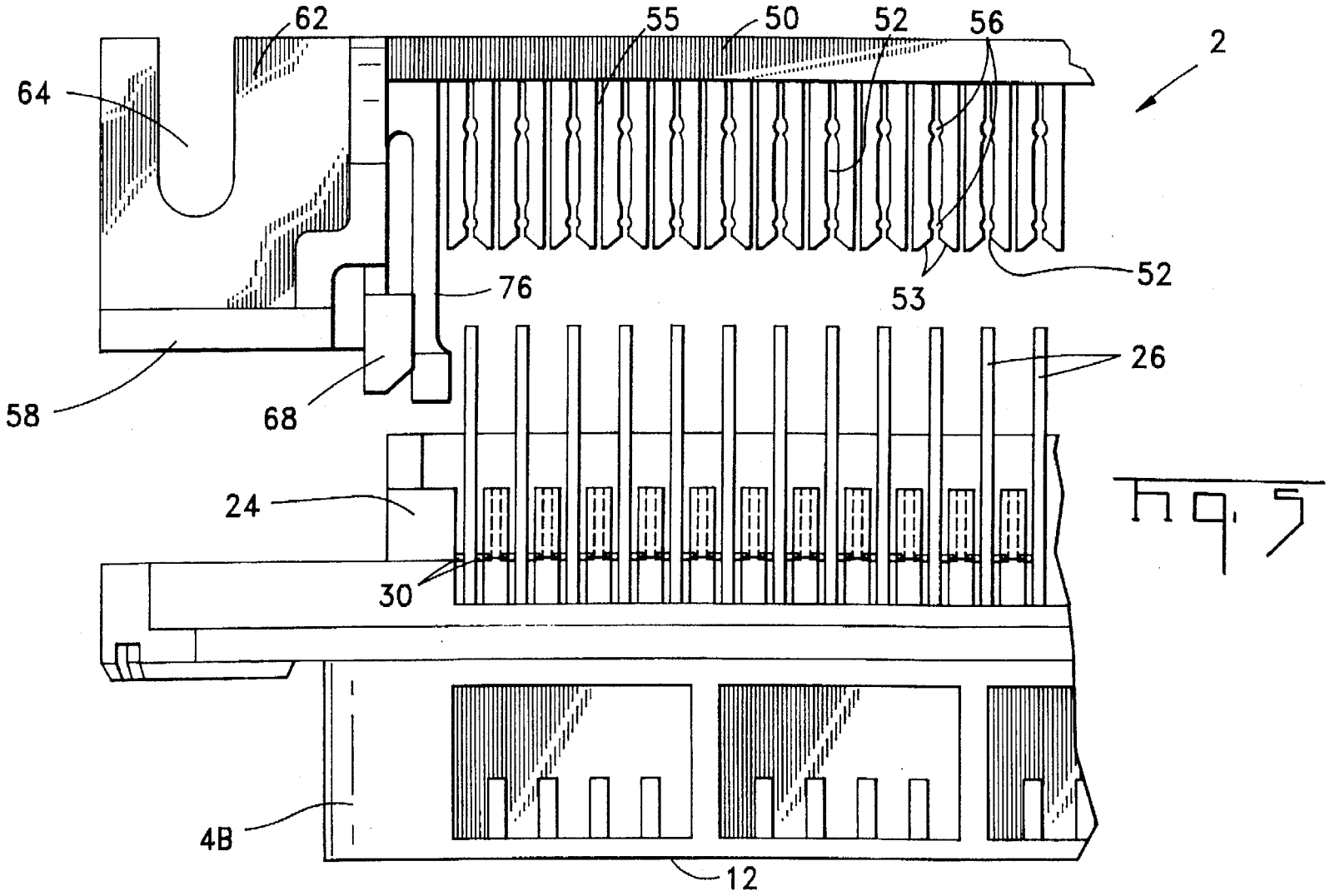
FIG. 5 is a bottom view of the electrical connector and the lead positioning comb with the slots in the lead positioning comb aligned with the terminal leads prior to the assembly of the comb to the connector.
Figure 6:
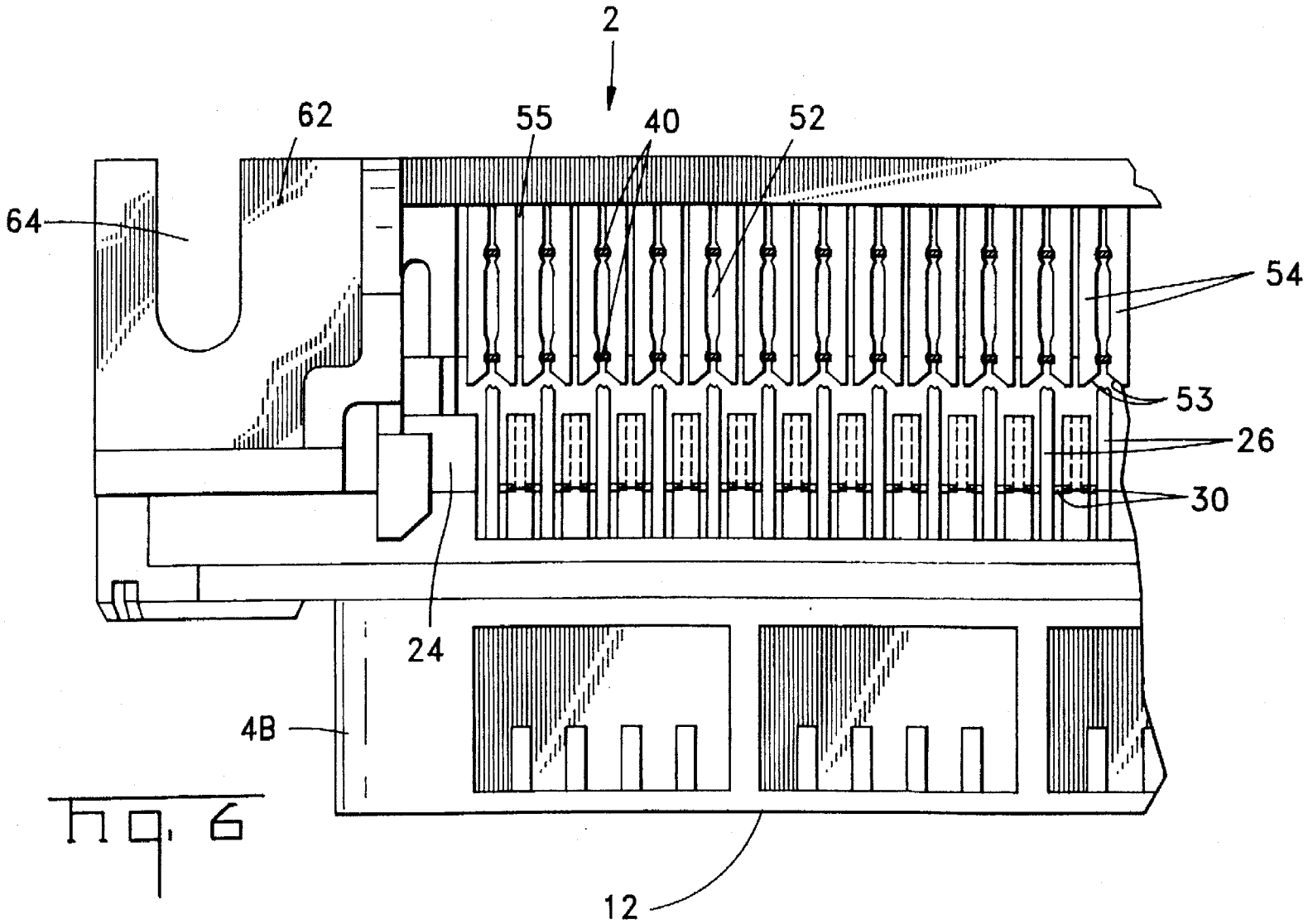
FIG. 6 is a bottom view looking from the same direction as in FIG. 5, showing the comb assembled to the connector. Portions of this view have been broken away to reveal details of the assembly.
Figure 7:
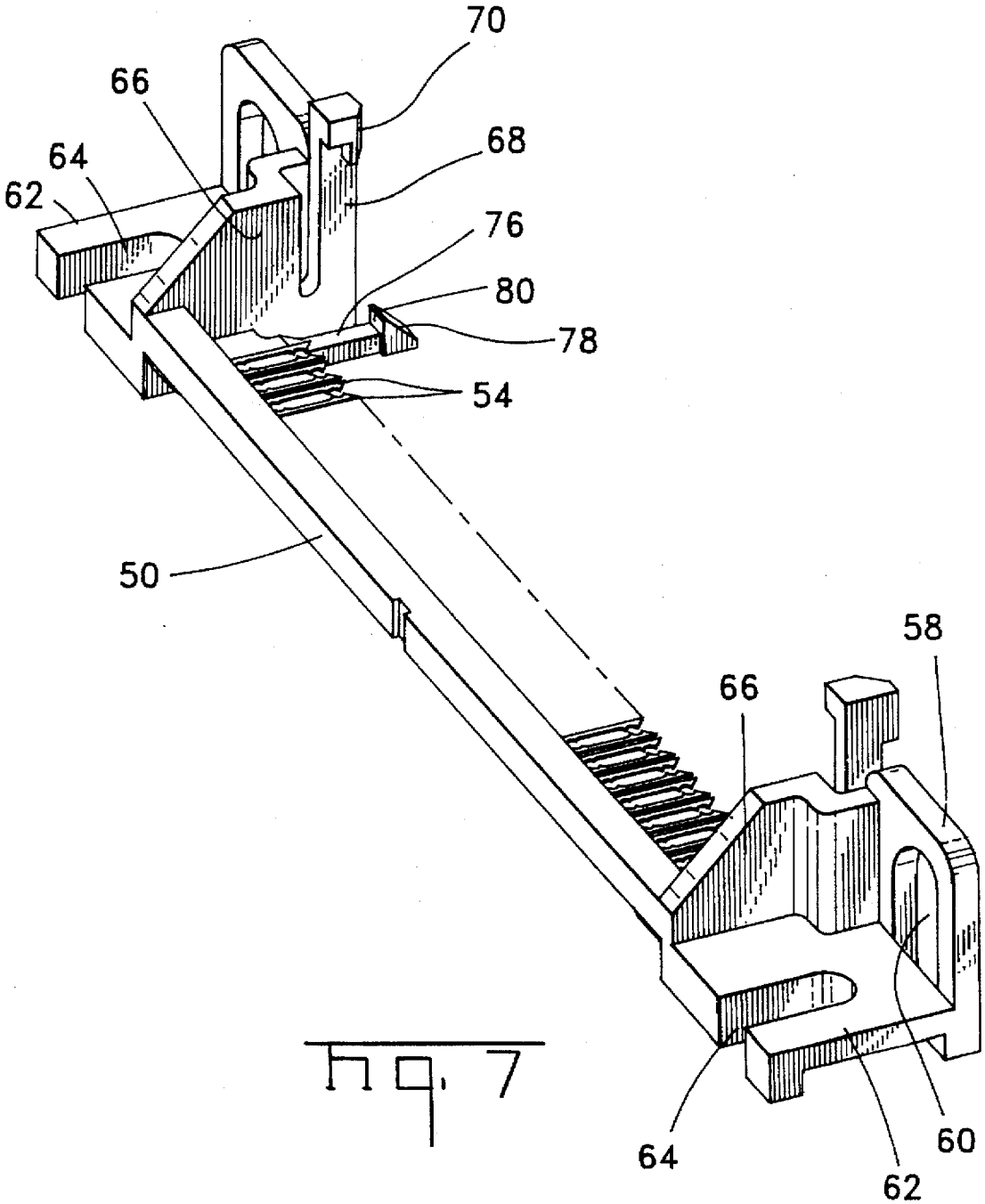
FIG. 7 is a perspective view of the lead positioning comb.
Figure 8:
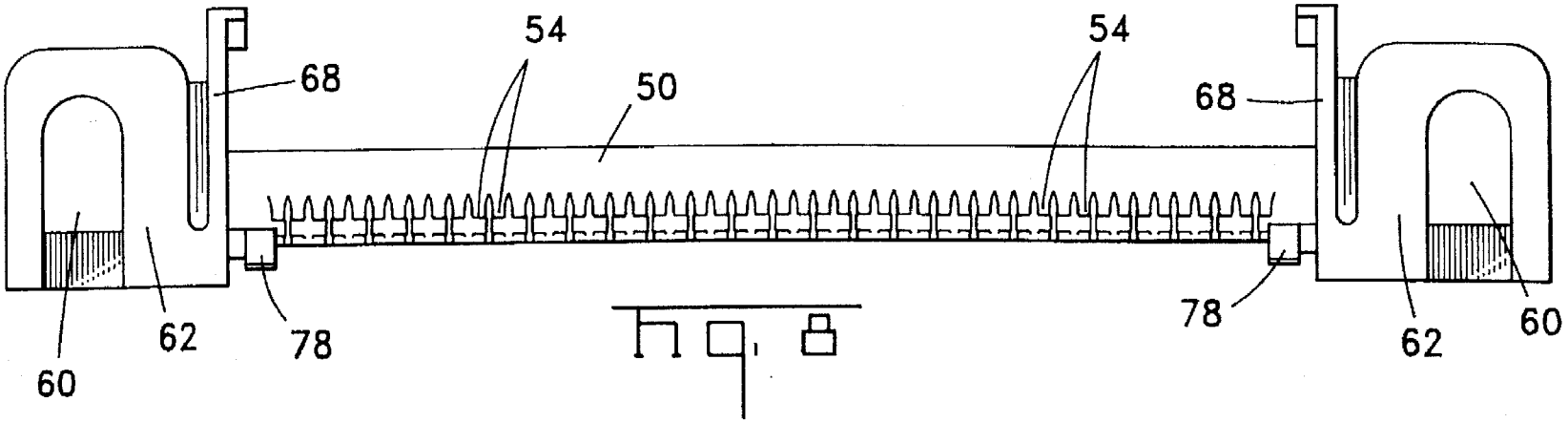
FIG. 8 is a front view of the lead positioning comb
Figure 9:
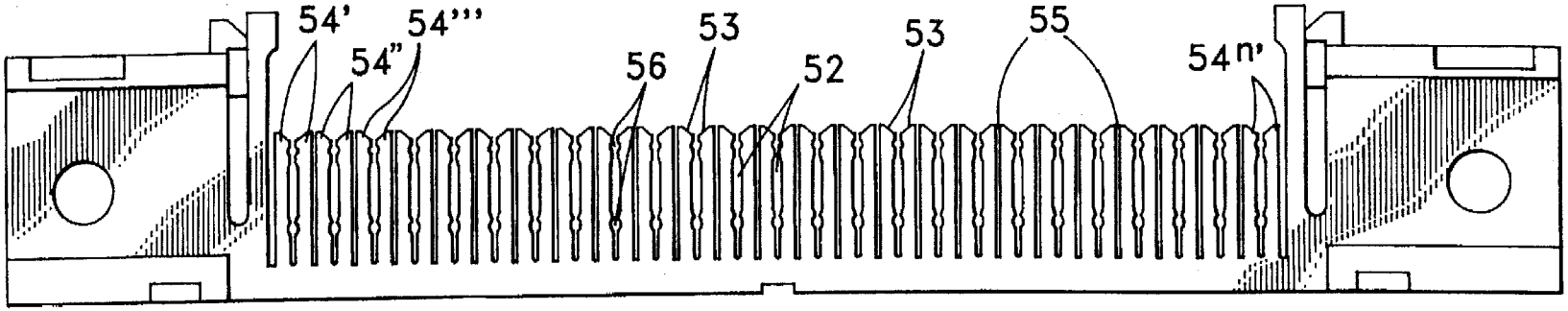
FIG. 9 is a top view of the lead positioning comb showing the paired cantilever beams forming the lead positioning slots and showing the unpaired cantilever beams on either side of the relief slots.

The rear face 14 of this preferred embodiment of the miniature ribbon electrical connector is identical for both male and female, or plug and receptacle, connectors and for both the cable and printed circuit board connector versions. Therefore the same lead positioning comb 48 can be used with both plug and receptacle connectors. A female connector 4A is shown in FIGS. 2–4, and a male connector 4B is shown in FIGS. 5 and 6. Other versions of miniature ribbon connectors may employ rear face that differs from that of the preferred connector depicted herein and the preferred embodiment of the lead positioning comb 48 may not be operable with all miniature ribbon connector versions. Certain changes, primarily in the configuration of the comb latches, will be necessary for those other miniature ribbon connector configurations, but changes to the comb latches do not entail changes to the lead positioning slots 52 or the cantilever beams 54 or the assembly of the lead positioning comb 48 from the rear.

As shown in FIG. 1 and FIGS. 5–9, the injection molded one piece lead positioning comb 48 has a base 50 from which the cantilever beams 54 extend. Cantilever beams 54 are parallel to a common plane. The height of each beam is 0.08 inch, the length is 0.30 inch and the thickness varies between 0.023 and 0.0295 inch in the preferred embodiment. These dimensions are understood to vary within the range of normal engineering tolerances for injection molding operations. These flexible beams 54 define the lead positioning slots 52 that extend from the base 50 to a beveled slot entry 53 that faces the rear face 14 of the connector housing 8. The width of each slot 52 varies between 0.015 and 0.028 inch in the preferred embodiment. Each slot 52 includes a pair of notches 56 for positioning two terminal leads 40 at forward and aft locations in each slot. These notches 56 are positioned in the slots 52 to correspond to the holes or pads on the printed circuit board 6 on which the electrical connector assembly 2 will be mounted.

Two paired cantilever beams 54 form each slot 52. Paired cantilever beams are identified by the same prime number in FIG. 9. For example two beams 54' form one pair and two beams 54" form the next pair. Two adjacent beams form different pairs, for example adjacent beams from the pairs 54' and 54" are referred to as unpaired beams. Adjacent unpaired beams are separated by a relief slot 55. For example, two adjacent unpaired beams, again one from 54' and one from 54", are spaced apart and on opposite sides of a relief slot 55. These relief slots 55 permit beams from adjacent pairs to simultaneously flex outwardly towards each other in the plane occupied by all of the beams. Thus as the terminal leads 40 in one row simultaneously enter aligned slots 52, all of the beams 54 can flex outwardly due to the presence of the relief slots 55.

The base 50 and the cantilever beams 54 extend between connector mounting sections 58 and board mounting sections 62 located at both ends of the lead positioning comb 48. First and second connector mounting latches 68 and 76 are also located at either end and are separated from the mounting sections 58 and 62 by a support ledge 66. The first and second latches 68 and 76 snap the printed circuit board comb 48 to the connector 2. The first latch 68 extends perpendicular to the plane of the cantilever beams 54 and is configured to snap onto the end ledge 24 on the electrical connector 4. First latch 68 includes a front bevel surface 70 that cams the first latch 68 outward as the lead positioning comb is mated to the electrical connector 4. A latching pocket 74 (see FIG. 3) located on the opposite face of first latch 68 is configured to fit around the connector ledge 24. The second mounting latch 76 extends parallel to the cantilever beams 54 and perpendicular to the first latch 68. This second latch includes a forward camming surface 78 for flexing the second latch during engagement of the lead positioning comb 48 to the connector 4 and a shoulder 80 to engage the connector ledge 24 on the opposite side of the connector rib 22 from the first mounting latch 68. The first and second latches 68 and 76 thus provide the means for attaching the lead positioning comb 48 to the connector housing 8.

The connector mounting sections 58 and board mounting sections 62 on each end form an L-shaped bracket for securing the connector assembly 2 to a mating electrical connector (not shown) and for mounting the electrical connector assembly 2 to the printed circuit board 6. Conventional fasteners (not shown) are inserted in connector latch mounting openings 60 and hold down openings 64 to secure the mated connectors together and the assembly 2 to the printed circuit board 6. Openings 64 are shown as slots in this embodiment, but a hole or raised boss for receiving a self-tapping screw could also be employed. The lead positioning comb 48 thus provides a means for mounting an electrical connector 4, that includes a standard cable connector housing 8 that does not have any printed circuit board mounting means, to a mating connector and to a printed circuit board.

Figure 10:
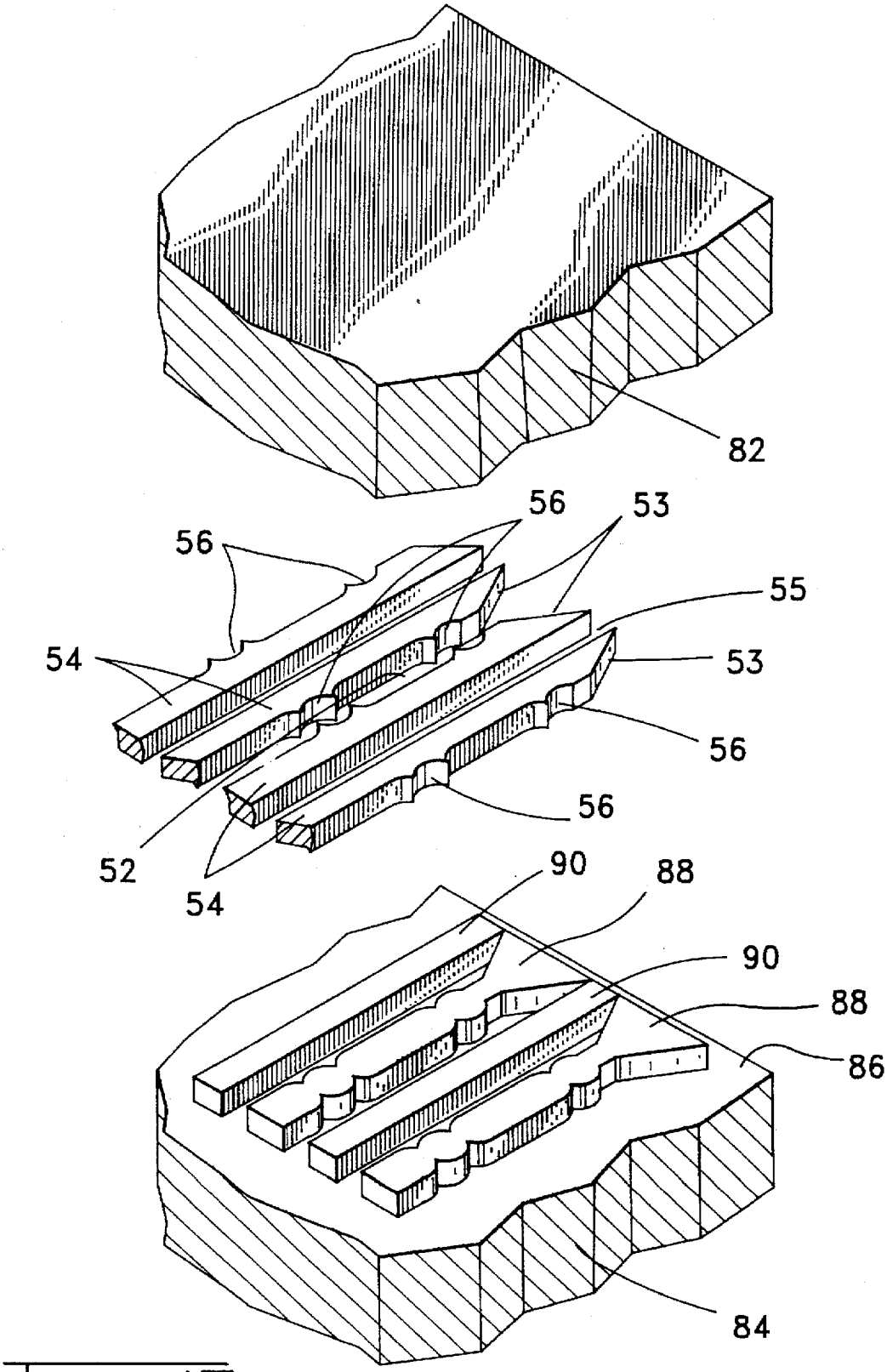
FIG. 10 is a view of a portion of the cantilever beams and lead positioning slots formed by these beams and illustrating the portions of the two mold halves used to fabricate these cantilever beams and slots and the direction in which these mold halves move away from the parting line after molding is complete.

The comb mounting sections 58, the board mounting section 62, the support ledge 66, the first mounting latches 68 and the second mounting latches 76 are all located on the ends of the lead positioning comb 48. The cantilever beams 54 located in the center of the comb 48 are unobstructed both above and below. In this way the relatively thin beams 54 separated by slots 52 and 55 can be molded by an upper mold section 82 and a lower mold section 84 that join on a parting line or plane parallel to the cantilever beams 54 as depicted in FIG. 10. Since the cantilever beams 54 are formed without undercuts in the direction perpendicular to their plane, they can be formed by straight pull of the mold pieces without the need for any side pulls or any additional mold pieces that must be withdrawn perpendicular to the relative motion between upper mold 82, lower mold 84 and the molded comb 48 during removal of the comb 48 from the mold. Furthermore, the relatively thin cantilever beams 54 surrounded by the relatively narrow slots 52 and 55 can be formed by blades 88 and 90 on one of the mold pieces. Since these blades need not be long and thin, as would be necessary if the mold blades were withdrawn along the axes of slots 52 and 55, these blades 88 and 90 will not be fragile and prone to damage during normal molding operations. Furthermore, this molding technique will permit the mold to properly fill so that voids do not result during the injection of thermoplastics, such as Valox, into the mold. Valox is a trademark of General Electric Plastics. Examination of FIGS. 1 and 5–9 will also reveal that the other structures forming parts of the one piece lead positioning comb 48 can also be formed in a mold cavity defined by only upper and lower mold pieces without the need for any side pulls.

FIGS. 2–4 show the steps in assembling the lead positioning comb 48 to the electrical connector 4 to form the final printed circuit board connector assembly. After the terminals 26 have been inserted in the connector housing 8 and with the carrier strips 46 remaining intact, the terminal lead sections 40 are bent to form right angle bends 36 adjacent to the rear face 14 of the connector 4. The top row of terminals extend further back than the lower row, but identical terminals can be used in each row because this bending operation only takes place after insertion of the terminals 26 into the housing 8. Note that the carrier strips 46 will be offset as shown in FIG. 1 when identical terminal strips are used. At this point the lead positioning comb is positioned at the rear of the connector 4 and moved toward the housing rear face 14 and snapped into engagement with the connector 4. As shown in FIG. 3 the mounting latches 68 and 76 can cam outwardly during this assembly step. Since the carrier strips 46 remain intact the rows of terminals can be inserted into their respective slots 52 and finally into the notches 56 to correctly position them. At this point the carrier strips 46 can be removed by a suitable punch which also chamfers the terminals ends for insertion into a printed circuit board. Although the terminal ends will normally remain straight to form through hole leads 42, FIG. 4 shows that the ends of the leads may be bent to form surface mount leads 44.

Although the lead positioning comb 48 is specifically intended for use with a miniature ribbon connector of the type shown in U.S. Pat. No. 3,760,335, other lead positioning combs could be employed with other electrical connectors without departing from the subject matter of one or more of the claims set forth in this application. For example, other means could be provided to attach the connector to a miniature ribbon connector of the type depicted herein or of other miniature ribbon connectors. The lead position comb could be attached by screws or other separate fasteners for example. Modifications to the structure of the lead positioning comb could be made to permit a comb with a array of flexible cantilever beams to fit on a connector having a different rear face construction. Although this invention is especially suitable for use with terminal leads that are unformed and comprise only a thin flat member, this invention is also not limited to use with miniature ribbon connectors. For example, this invention could also be used with other standard connectors such as rectangular DIN connectors. Therefore the invention is not limited in scope to the preferred embodiment depicted herein and its use in modified configurations would be apparent to one of ordinary skill in the art upon inspection of this representative embodiment.

I claim:

1. An electrical connector assembly for use with a printed circuit board comprising:

a housing including a plurality of cavities located in at least one row between opposite housing faces;

terminals positioned in the cavities, each terminal extending from a corresponding cavity and then extending at a right angle relative to the corresponding cavity along one face of the housing and including a printed circuit board terminal lead at a distal end; and a lead positioning comb attachable to the housing, the comb including a plurality of side by side slots formed by cantilever beams located in a common plane and extending from a base toward the housing, the slots having respective open ends, facing the housing, through which the terminal leads enter as the comb is moved toward the housing for attachment to the housing, adjacent said cantilever beams defining adjacent said slots being spaced apart by relief slots which permit the adjacent beams to outwardly flex, in the common plane, as side by side terminal leads are simultaneously inserted into the side by side slots.

2. The electrical connector assembly of claim 1 wherein the lead positioning comb includes mounting latches on opposite ends of the base for attaching the lead positioning comb to the housing at opposite ends thereof.

3. The electrical connector assembly of claim 1 wherein the housing includes a mating face and a rear face, the terminal leads extending from the rear face of the housing, the lead positioning comb being attachable to the rear face of the housing.

4. The electrical connector assembly of claim 1 wherein each slot is configured to position the corresponding terminal lead at a specified position in the slot so that the terminal lead is properly positioned for attachment to a circuit on a printed circuit board when the electrical connector assembly is mounted on a printed circuit board.

5. The electrical connector assembly of claim 4 wherein at least one notch is located on a cantilever beam on at least one side of each slot to engage the corresponding terminal lead to position the terminal lead at the specified position.

6. The electrical connector assembly of claim 1 wherein terminals are positioned in two rows and two terminal leads, one from each row, are positioned in each slot.

7. The electrical connector assembly of claim 1 wherein the terminal leads are rectangular in cross section with the longer cross section dimension of each lead spanning the corresponding slot.

8. The electrical connector assembly of claim 7 wherein the thickness of each terminal does not exceed 0.010 inch.

9. The electrical connector assembly of claim 7 wherein the thickness of each terminal does not exceed 0.0085 inch.

10. The electrical connector assembly of claim 1 wherein the electrical connector comprises a miniature ribbon electrical connector.

11. The electrical connector assembly of claim 1 wherein the terminals are stamped and formed, each terminal comprising a mating section in addition to the terminal lead section, each terminal lead and each mating section comprising a flat section.

12. The electrical connector assembly of claim 1 wherein the electrical connector is an IEEE 488 interface connector.

13. An electrical connector assembly comprising:

a first housing having a plurality of terminal leads extending from one side and a terminal lead positioning comb attached to the first housing with the terminal leads extending through the terminal lead positioning comb so that the terminal leads are positioned in a specified pattern for mounting on a printed circuit board, the terminal lead positioning comb including a base with a plurality of flexible cantilever beams extending from the base toward the first housing, the cantilever beams being positioned side by side in a plane, pairs of the cantilever beams forming slots in which individual said terminal leads are positioned, each said slot including an opening at the free end of the cantilever beams facing the first housing through which the terminal leads enter the corresponding slots, and adjacent said cantilever beams forming parts of separate pairs of cantilever beams defining adjacent said slots are spaced apart to permit adjacent non-paired cantilever beams to simultaneously outwardly flex in the plane occupied by the beams as the terminal leads enter the adjacent said slots.

14. The electrical connector assembly of claim 13 wherein the terminal lead positioning comb is attached to the first housing at opposite ends of the base by first latches extending perpendicular to the cantilever beams and by second latches extending parallel to the cantilever beams.

15. The electrical connector assembly of claim 13 wherein the terminal leads are bent at right angles on the exterior of the first housing.

16. The electrical connector assembly of claim 15 wherein only the terminal leads extend above the cantilever beams.

* * * * *